United States Patent [19]

Neuhaus

[11] Patent Number: 4,602,538

[45] Date of Patent: Jul. 29, 1986

[54] ONE-ARMED TORQUE WRENCH

[75] Inventor: Klaus Neuhaus, Wuppertal, Fed. Rep. of Germany

[73] Assignee: Eduard Wille GmbH & Co., Wuppertal, Fed. Rep. of Germany

[21] Appl. No.: 727,112

[22] Filed: Apr. 25, 1985

[30] Foreign Application Priority Data

May 26, 1984 [EP] European Pat. Off. ..... 84710017

[51] Int. Cl.[4] ..... B25B 23/14

[52] U.S. Cl. ..... 81/467

[58] Field of Search ..... 81/467, 429, 477, 478, 81/483

[56] References Cited

U.S. PATENT DOCUMENTS

| | | | |
|---|---|---|---|
| 2,900,855 | 8/1959 | Van Hoose | 81/483 |
| 2,924,134 | 2/1960 | Harmes | 81/467 |
| 3,763,724 | 10/1973 | Green | 81/477 |
| 3,869,941 | 3/1975 | Tsuji | 81/52.2 |

FOREIGN PATENT DOCUMENTS

| | | | |
|---|---|---|---|
| 3139374 | 4/1983 | Fed. Rep. of Germany . | |
| 2242202 | 3/1975 | France . | |
| 747711 | 7/1980 | U.S.S.R. | 81/478 |

OTHER PUBLICATIONS

Catalog D89 of Eduard Wille GmbH & Co., pp. 100–101.

*Primary Examiner*—Frederick R. Schmidt
*Assistant Examiner*—Debra S. Meislin
*Attorney, Agent, or Firm*—Lee, Smith & Zickert

[57] ABSTRACT

A torque wrench having a shaft with a tool head at one end a handle at the other end. The handle is supported on a lever system having a first and a second two-armed lever. One arm of the first lever engages one arm of the second lever. The handle is supported at two points on the other arm of the first lever and the other arm of the second lever. The other arm of the first lever engages a force sensor, which is attached to the shaft. The levers are dimensioned such that the measuring force acting upon the force sensor, when an applied force acts on the handle, is independent of the point of application of the applied force and is always proportional to the torque exerted about the axis of rotation of a tool.

3 Claims, 2 Drawing Figures

ONE-ARMED TORQUE WRENCH

The invention relates to a one-armed torque wrench, comprising (a) a shaft, which at one end has a tool head for a tool, (b) a force sensor at the other end of the shaft, and (c) a handle, which is mounted at the other end of the shaft at two points on a lever system having two levers mounted pivotably on the shaft, which lever system is arranged to exert a force on the force sensor, which force is only dependent of the torque exerted about the point of rotation of the tool, but not of the point of attack at the handle.

A bolt or another threaded element shall be tightened with a predetermined torque by means of a torque wrench. This ensures, on one hand, that the screw is sufficiently tightened in a well-defined way. On the other hand it prevents the thread from ripping off as a result of too strong tightening of the bolt.

With prior art torque wrenches measurement of the exerted torque is effected by means of the most different measuring systems.

In on known torque wrench for example a bending bar serves as torque sensor, on which the handle is provided through which the torque is transmitted to a tool engaging the screw. The bending bar is deflected as a function of the transmitted torque. A mark is provided on a housing portion, which is not loaded by the torque transmission and which extends along the bending bar. When the bending bar is deflected, this mark moves over a dial provided on the bending bar. The applied torque can be read from this dial.

Other torque wrenches based on a similar principle are known, with which a signal is given for example in form of a noticeable jerk or a click when a certain preset torque is attained (catalogue D 89 of Eduard Wille GmbH & Co., 5600 Wuppertal-Cronenberg).

In the prior art torque wrenches an auxiliary torque is indicative of the torque exerted about the axis of rotation of the bolt, which auxiliary torque is effective about an axis outside this axis of rotation. Thus the torque indication or rather the torque, at which the signal is given, depends on the point, at which the user engages the torque wrench.

FR-A-2,242,202 discloses a torque wrench of the above defined type, which avoids these problems. In this prior art torque wrench a projection is provided on the shaft at its end remote from the tool head, which projection extends into the tubular handle. An elongated movable element is arranged parallel to this projection in the handle and engages the inner wall of the handle through rollers. The movable element is connected to the projection through two links of different lengths, which accordingly form different angles with the longitudinal direction of the projection. An adjustable compression spring extends between the projection and the movable element and urges the movable element in the direction toward the shaft, the handle, being kept in engagement with a stop means on the projection through the links and the rollers. The links are two levers which are mounted pivotably on the shaft and form a lever system together with the elongated movable element. The handle is mounted on this lever system at two points, namely on the two rollers. In the prior art torque wrench the links or levers together with the compression spring form a toggle lever mechanism. At a certain torque the toggle lever mechanism yields, overcoming the bias of the spring. The elongated element engages the projection. The user feels this at a corresponding yielding of the handle, which, in turn, is supported on this element through the rollers. By appropriate choice of the angle between the links and the longitudinal direction of the projection, it is possible to make this snap point of the toggle lever mechanism independent of the point, at which the force is applied to the handle and a well-defined torque is exerted about the axis of rotation of the tool. In this prior art torque wrench the toggle lever mechanism serving as dynamometer and the lever transmission for compensation of the lengths of the lever arms are integrated. Levers or links are arranged, which extend at an angle relative to the longitudinal direction of the shaft. The angles between these links and the longitudinal direction of the shaft have to be chosen in a certain well-defined way to compensate for the lengths of the lever arms. Therefore relatively long levers are required. Thus the toggle lever mechanism and thus the handle enclosing the toogle lever mechanism become quite unwieldy.

DE-A-3,139,374 discloses a mechanical torque wrench, with which likewise an indication is obtained independent of the point of engagement. In one embodiment of DE-A-3,139,374 the deflection of the shaft at a mechanically weakened first point is converted into a stroke through a first lever arranged on the shaft on the tool side of this point. The stroke is measured by means of a dial gauge, which is arranged on the shaft and engages the first lever. A second mechanically weakened point of the shaft is provided in order to eliminate the dependency on the point of engagement, which results from the distance between said first point and the point of rotation of the tool. On the handle side of this second point a second lever carrying the dial gauge is attached to the shaft. When a torque is exerted on the torque wrench, the shaft is slightly bent also at the second point and causes a pivotal movement of the second lever with the dial gauge. Appropriate selection of the lengths of the lever arms permits the indication of the dial gauge to be indicative of the torque exerted about the point of rotation of the tool. In another embodiment of DE-A-3,139,374 based on a similar principle, a toggle lever mechanism is provided instead of a dial gauge, which toggle lever mechanism snaps at a snap point unambiguously depending on the exerted torque.

In this torque wrench the measuring elements and the levers for compensation for the lengths of the lever arms are located on the shaft, whereby handling of the torque wrench is made more difficult.

It is the object of the invention to obtain a simple and compact construction of the toggle lever mechanism in a tension wrench of the above defined type, with which a force sensor and a lever mechanism for the above described compensation of the lever arm ratios are arranged in a handle, such that this toggle lever mechanism can be placed in a slender handy handle.

According to the invention this object is achieved in that (d) the two levers of the lever system are two-armed levers, engaging each other with a first arm each, (e) the handle is supported at its ends on the second arm of the two levers, and (f) the force sensor responds to the force exerted between the second arm of a lever and the shaft.

The lever system consists of two levers, which extend in the longitudinal direction of the shaft, such that the lever system is simple and elongated. Thus it can by placed in a slender handle in a space-saving way. The proportion of the lengths of the lever arms of the lever system for obtaining a measurement independent of the point of engagement can be provided reproducibly and with high precision. The function of the lever system is completely separated from the function of the force sensor, such that any type of force sensor can be used.

Further modifications of the invention are subject matter of the sub-claims.

Two embodiments of the invention will now be described in greater detail with reference to the accompanying drawings.

Figure 1:
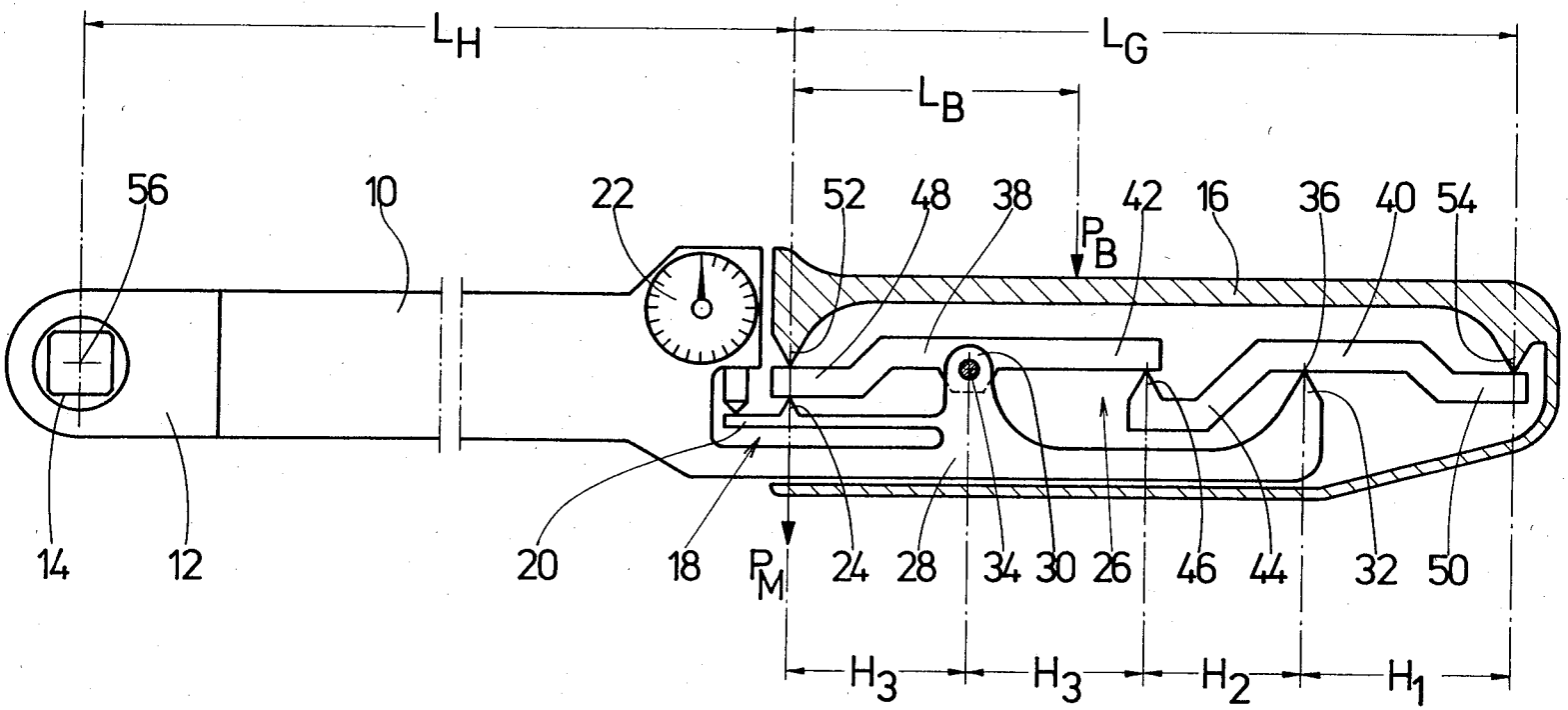
FIG. 1 is a schematic illustration for illustrating the principle of the torque wrench and shows a measuring torque wrench, which provides an indication of the exerted torque.

The torque wrench according to FIG. 1 comprises a shaft 10, which has a tool head 12 at one end. The tool head 12 has a square 14, on which a socket wrench insert can be placed. A handle 16 is located at the other end of the shaft 10. A torque sensor is formed by a force sensor 18 arranged between the handle 16 and the shaft 10. In the embodiment of FIG. 1, the force sensor 18 consists of a bending body 20, which is inserted into an end face of the shaft 10, and of a dial gauge 22 held in the shaft 10 and engaging the bending body 20. The force exerted on the torque wrench by the user is transmitted from the handle 16 through an edge 24 in a way to be described hereinbelow. The force-proportional deflection of the bending body 20 is measured by the dial gauge 22 and indicated as a measure of the force and thus of the exerted torque.

The force exerted on the shaft 10 through the handle 16 for providing a torque is applied to the force sensor 18 through a lever system 26, such that the force acting on the force sensor 18 is proportional to the exerted torque independently of the point of attack of the force exerted on the handle 16. For this purpose an arm 28 is provided on the shaft 10, which arm 28 extends into the interior of the hollow handle. The arm 28 carries spaced from each other a joint 30 and an edge 32, which defines the pivot axes 34 and 36, respectively, for a first two-armed lever 38 and for a second two-armed lever 40. Thus the two levers 38 and 40 are mounted on the shaft 10 in the area of the handle 16. The two levers 38 and 40 engage each other with a first arm each 42 and 44, respectively, through an edge 46 provided on the lever 40. In fact the arm 44 engages, with its edge 46, the arm 42 of the lever 38 from below in FIG. 1. The handle 16 is supported at its two ends on the second arms 48 and 50, respectively, from above in FIG. 1. This is done through edges 52 and 54, respectively, in the schematically illustrated embodiment of FIG. 1. The force sensor 18 responds to the force exerted between the second arm 48 of the lever 38 and the shaft 10. For this purpose the edge 24 of the bending body 20 engages the arm 48 of the lever 38 on the bottom side in FIG. 1. The handle 16 engages, with its edge 52, the arm 48 of the lever 38 on the opposite side, that is the upper side in FIG. 1, which edge 52 is aligned with the edge 24. The first arm 48 of the first lever 38 has the same length H3 of the lever arm between a point of support of the handle 16 on the first lever 38 defined by the edge 52 and the pivot axis 34 defined by the joint 30 as the lever arm between the pivot axis 34 and the point of engagement of the second lever 40 defined by the edge 46. The length H1 of the lever arm of the arm 50 of the second lever 40 between the point of support of the handle 16 on the second lever 40 defined by the edge 54 and the pivot axis 36 of the second lever 40 defined by the edge 32 has the same proportion relative to the length H2 of the lever arm of the first arm 44 of the second lever 40 between the pivot axis 36 and the point of engagement of the first lever 38 defined by the edge 46 as the distance LH+LG of the point of suport of the handle 16 on the second lever 40 from the point of rotation 56 of the torque wrench to the distance LH of the point of support of the handle 16 on the first lever 38.

The described arrangement operates as follows:

An actuating force $P_B$ acts on the handle 16 at the distance LH+LB (FIG. 1) from the point of rotation 56. The point of attack of the actuating force $P_B$ can be anywhere along the length LG of the handle 16. LH designates the length of the shaft 10 measured from the point of rotation 56 to the point of support of the handle 16 on the lever 38. The tightening torque is therefore $$M = P_B(LH + LB) \tag{1}$$

This tightening torque is to be measured. The measuring force $P_M$ acting on the force sensor 18 is composed of two components, namely a first component, which is transmitted directly from the handle 16 to the bending body 20 through the edge 52. This component is $$\frac{P_B(LG - LB)}{LG}$$

The second component is effective through the edge 54 of the handle 16 and the lever system 26. The edge 54 transmits to the second lever 40 a force $$\frac{P_B \cdot LB}{LG}.$$

This force seeks to rotate the lever 40 clockwise. The arm 44 of the lever 40 transmits a force directed upwards to the arm 42 of the lever 38 through the edge 46, which force is $$\frac{PB \cdot LB \cdot H1}{LG \cdot H2}$$

due to the different lengths H1 and H2 of the lever arms. The lever 38 having equal lengths H3 of the lever arms only serves to reverse the force direction. It exerts with the arm 48 an additional force directed downwards on the force sensor 18, which force has the above mentioned amount. Thus a force $$P_M = \frac{P_B}{LG}(LG - LB + \frac{LB \cdot H1}{H2}. \tag{2}$$

acts on the force sensor 18.

As mentioned above, H1 and H2 are selected such that $$\frac{H1}{H2} = \frac{LH + LG}{LH} \tag{3}$$

Introducing this relation into equation (2), yields $$M = P_M \cdot LH = P_B(LH + LB). \quad (4)$$

Thus the measuring force $P_M$ with the constant and known coefficient of proportionality LH is always proportional to the tightening torque, regardless of the point (or the distance LB), at which the user exerts a force on the handle 16. Thus the tightening torque M is always measured without systematic errors. The shaft 10 can be a simple rigid element, whereby the torque wrench can be made more slender and lighter.

Figure 2:
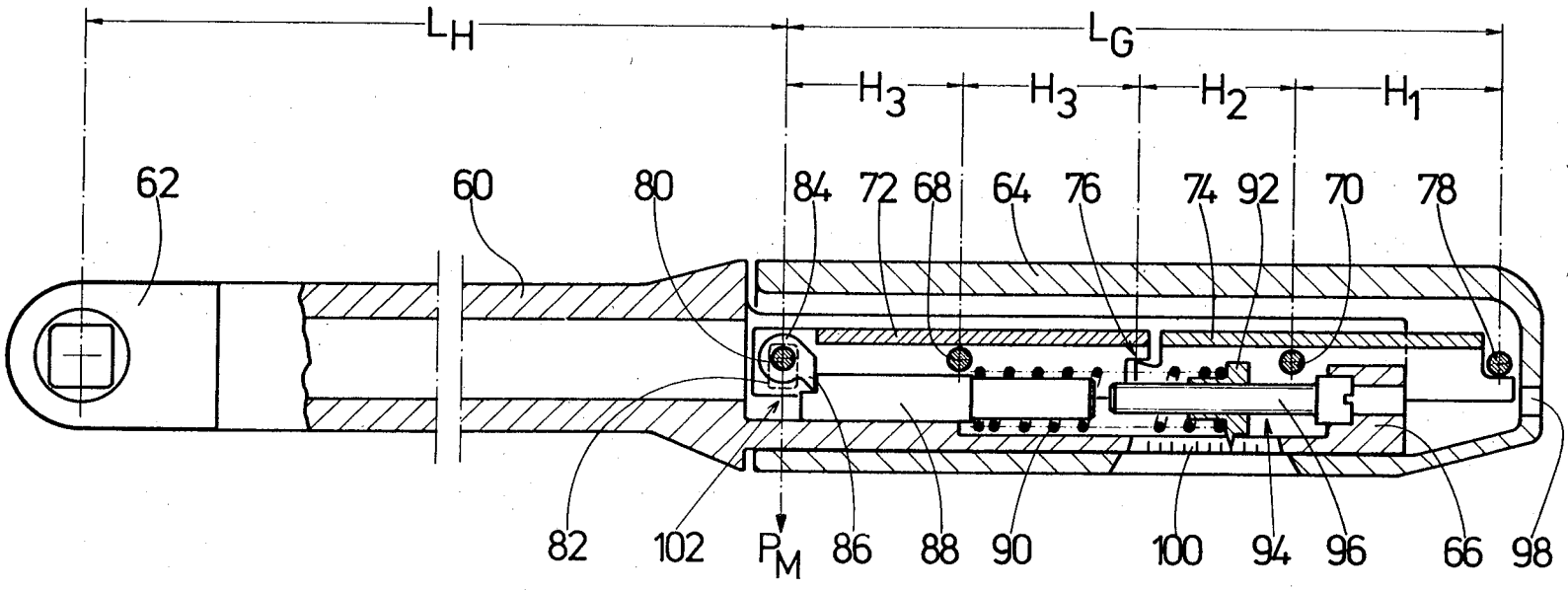
FIG. 2 shows, in a constructional illustration, a longitudinal section of a torque wrench, which provides a signal when a pre-adjustable torque is obtained.

FIG. 2 shows a constructional embodiment of a torque wrench.

A shaft 60 carries, at one end, a tool head 62 similar to the tool head 12 in FIG. 1 and, at the other end a handle 64. For application of the torque a force is exerted on the handle 64 from above in FIG. 2. The shaft 60 has a projection 66 extending into the handle 64, which projection 66 corresponds to the arm 28 of FIG. 1 with regard to its function. Bearing pins 68 and 70 are located in the projection 66, which bearing pins correspond to the joint 30 and the edge 32, respectively, of FIG. 1. Two armed levers 72 and 74, respectively, are mounted on the bearing pins 68 and 70. the two levers 72 and 74 engage each other with stop faces at 76. A pin 78 is located in the handle 64 and engages a stop face at the outer end of the lever 74. The pin 78 corresponds to the edge 54 of FIG. 1 with regard to its function. A further pin 80 corresponding to the edge 52 of FIG. 1 is provided on the handle 64. This pin 80 extends with sufficient clearance through an aperture 82 in the projection 66. Furthermore the handle 64 is pivotably mounted with the pin 80 at the end of the lever 72. Furthermore a tilting body 84 having a lug 86 is mounted on the pin 80. The lug is supported with a plane surface on a L-shaped recess of a slide 88, which is longitudinally movably guided in the projection 66. The slide 88 is exposed to the action of a biased spring 90, which is supported on an abutment 92 and which urges the slide 88 towards the left in FIG. 2. This abutment 92 is straightly guided by a guide 94 and guided as a nut on a threaded spindle 96. The threaded spindle 96 is adjustable through an aperture 98 in the handle 64 by means of a screw driver. Thereby the abutment 92 can be displaced in longitudinal direction and the bias of the spring 90 can be varied. The guide 94 is provided with a graduation 100, along which an indicator connected to the abutment 92 is movable.

The described arrangement operates as follows:

Because of the levers 72 and 74, the lengths of the lever arms of which correspond to those in FIG. 1, the measuring force $P_M$ acting on the pin 80 downwards in FIG. 2 is proportional, as in the embodiment of FIG. 1, to the exerted tightening torque independently of the point, at which the user engages the handle 64. The tilting body 84 in combination with the spring-loaded slide 88 serves as "force sensor" 102. In the state of rest the tilting body 84 is kept in the illustrated position by the spring 90. When the measuring force $P_M$ exceeds a predetermined value, the force component effective in the longitudinal direction overcomes the bias of the spring 90 just like in a toggle lever. The slide 88 snaps to the right in FIG. 2, the pin 80 moves downwards and the tilting body 84 is pivoted counterclockwise. Due to the lever arrangement also the pin 78 moves downwards at the same time as the pin 80. Thereby the handle 64 makes a sudden movement clearly perceptible to the user, which movement suddenly stops when the upper inner surface of the handle abuts against the top edge of the projection 66. Thereby the tilting body 84 is pivoted so far, that the effective force component does not quite reach the dead-center position of the toggle lever and therefore all the movable elements automatically return to their initial positions after the handle has been released. The sudden movement of the handle in combination with the impact sound gives a signal, which indicates that a certain tightening torque is attained. The magnitude of the torque, at which the signal is given, is adjustable by means of the adjusting spindle 96 with the aid of the graduation 100.

I claim:

1. One-armed torque wrench comprising (a) a shaft having a first and a second end, (b) a tool head provided at said first end and adapted to receive a tool, defining an axis of rotation thereof, (c) a force sensor means provided at said second end of said shaft, (d) a lever system provided at said second end of said shaft and comprising a first lever and a second lever mounted pivotably on said shaft, (e) a handle mounted on said lever system at a first point and a second point, (f) said lever system being arranged to exert a measuring force on said force sensor means, when an applied force is exerted on said handle at a point of application thereof, in order to exert a torque about said axis of rotation of said tool, said measuring force exerted on said force sensor means being dependent only on said torque and not on said point of application of said applied force at said handle, characterized in that (g) said first lever is a two-armed lever having a first arm and a second arm and having a first side and a second side, (h) said second lever is a two-armed lever having a first arm and a second arm and having a first side and a second side, (i) said first arm of said first lever engaging, on the first side thereof, said first arm of said second lever on the second side thereof, (j) said handle is supported at said first point on said second arm of said first lever, on said second side thereof, (k) said handle is supported at said second point on said second arm of said second lever, on said second side thereof, (l) means in engagement with the shaft for transmitting forces between the second arm of the first lever and the force sensor means, (m) whereby the measuring force exerted on said force sensor comprises a first component due to the force which is transmitted to said second arm of said first lever from said handle through said second lever and said first arm of said first lever, and a second component transmitted from said handle directly at said first point to the second side of said second arm of said first lever, (n) wherein said applied force is transmitted to said force sensor means independently of the location of the point of application along said handle.

2. Torque wrench as set forth in claim 1, characterized in that (a) the lengths of the first and second arms of the first lever are the same, said second arm being between said first point and a pivot axis of the first lever, and said first arm being between the pivot axis and a point of engagement of the second lever with the first lever, (b) the lengths of the first and second arms of the second lever are in the same ratio as the distances of said second and first points, respectively, from the axis of rotation of the torque wrench, said first arm being between said second point and the pivot axis of said second lever, said second arm being between the pivot axis of the second lever and the point of engagement of the first lever with the second lever.

3. Torque wrench as set forth in claim 2, characterized in that (a) the said first point comprises the means in engagement with the shaft and is composed of a pin which is mounted in the handle and guided through a bore in the first lever, and (b) the force sensor comprises a tilting body, which is pivotably mounted on the pin and which engages a slide which is slidably guided in the longitudinal direction of said shaft and loaded by a biased spring.

* * * * *